US005815855A

United States Patent [19]

McKeehan et al.

[11] Patent Number: 5,815,855

[45] Date of Patent: Oct. 6, 1998

[54] SINK COVER

[76] Inventors: James H. McKeehan; Shirley McKeehan, both of 7801 NE. San Rafael Dr., Kansas City, Mo. 64119

[21] Appl. No.: 922,654

[22] Filed: Sep. 3, 1997

[51] Int. Cl.[6] ..... E03C 1/186

[52] U.S. Cl. ..... 4/631; 4/638; 4/656; 165/185

[58] Field of Search ..... 4/630, 631, 638, 4/654, 656; 165/10 A, 185

[56] References Cited

U.S. PATENT DOCUMENTS

| | | | |
|---|---|---|---|
| 914,120 | 3/1909 | Demarest | 4/638 |
| 2,308,123 | 1/1943 | Stein | 4/638 |
| 2,314,157 | 3/1943 | O'Brien | 4/631 |
| 3,385,357 | 5/1968 | Burg | 165/185 |
| 3,993,376 | 11/1976 | Meldahl | 312/228 |
| 4,033,461 | 7/1977 | Nevai | 198/597 |
| 4,305,166 | 12/1981 | Rose | 4/631 |
| 4,480,343 | 11/1984 | Drach | 4/656 |
| 4,589,150 | 5/1986 | Sciabarassi | 4/656 |
| 5,406,656 | 4/1995 | Somerton | 4/656 |

*Primary Examiner*—Robert M. Fetsuga
*Assistant Examiner*—Tuan Nguyen
*Attorney, Agent, or Firm*—Kenneth L. Tolar

[57] ABSTRACT

The present disclosure relates to a sink cover designed primarily for double sinks comprising a planar, substantially rectangular cover member having four peripheral edges, a bottom surface, a top surface and a plurality of recesses on the top and bottom surfaces. The recesses on one side receive conductive thawing plates while the other recesses receive microwaveable gel packs which engage the thawing plates. Frozen foods may then be placed onto the heated thawing plates to facilitate thawing. The cover member also has an aperture for receiving a hose which may be removably attached to a faucet so that water leaking therefrom will drip directly into the sink bypassing the cover member. A rubber gasket is disposed on the bottom surface of the cover member proximal its peripheral edges to provide a water tight seal when the device is placed over a sink.

6 Claims, 2 Drawing Sheets

SINK COVER

BACKGROUND OF THE INVENTION

Kitchen sinks, especially double sinks, occupy what would otherwise be available counterspace. Covering such sinks with a rigid platform greatly increases the available counterspace allowing various items to be placed thereon. In addition, kitchen sinks are often filled with dirty dishes greatly reducing the overall appearance of the kitchen. A kitchen sink cover allows a user to quickly and easily conceal a sink filled with dishes while simultaneously increasing the available counterspace. Often, such counterspace is used to thaw frozen foods thereon. The present invention relates to a cover for double sinks designed to increase the available counterspace. In addition, the sink cover contains removably attached microwavable gel packs engaging a pair of thawing plates to aid in thawing frozen foods placed thereon.

DESCRIPTION OF THE PRIOR ART

Various sink covers/counter space saving devices currently exist in the prior art. However, none of the prior art devices address the need for thawing frozen items thereon. U.S. Pat. No. 5,406,656 issued to Somerton relates to an adjustable sink cover and cutting board for fitting varying size sinks primarily designed for recreational vehicles.

U.S. Pat. No. 4,589,150 issued to Sciabarassi discloses a reversible drainboard for a corner sink installation.

U.S. Pat. No. 4,480,343 issued to Drach relates to a combination drain and cutting board adapted for use with a dish rack.

U.S. Pat. No. 4,033,461 issued to Nevai discloses a cleaning and draining device for a sink comprising a rectangular basket supported by a frame that slidably engages opposite edges of the sink. The device is designed to be filled with fruits, vegetables, meats, etc. so that the items may be rinsed.

U.S. Pat. No. 4,305,166 issued to Rose relates to a reversible double sink cover having a dish drying rack, cutting board or similar kitchen tool on one side and an ornamental design on the other. The device also has a plurality of apertures on the exterior surface to allow water dripping from the faucet to drain into the sink. Either of the covers may be lifted from the sink, turned over and placed flat on a counter to be used as a dish rack or cutting board. Furthermore, the cover has a plurality of magnets disposed along its periphery for removably attaching the cover to a metal sink.

U.S. Pat. No. 3,993,376 issued to Meldahl relates to a piece of furniture used to conceal a wash basin.

U.S. Pat. No. 2,314,157 issued to O'Brien discloses a bread and workboard to be used in conjunction with a sink or cupboard and which is stored within a slot along the sink. As indicated above, none of the prior art sink covers have means for facilitating the thawing of frozen foods nor are any configured with a hose attachment allowing a leaking faucet to easily drain into the sink preventing the water from contacting the sink cover.

SUMMARY OF THE INVENTION

The present invention relates to a cover for a double sink comprising a substantially planar cover member having rounded corners and dimensioned so that its peripheral edges rest upon the peripheral edges of the double sink. The planar cover member has an aperture therethrough. In addition, a plurality of microwavable gel packs are received within recesses on the bottom surface of the cover member and are removably attached using any suitable attachment means. The top surface of the planar cover member has preferably two thawing plates made from a highly conductive material such as aluminum or steel which rest within recesses on the top surface of the cover member such that the thawing plates are flush therewith. The gel packs may then be preheated in a microwave and attached to the bottom surface of the cover member so that frozen foods may be placed on the thawing palates and thawed thereon. A hose is received within the aperture and may be attached to a faucet to transport leaking water through the cover and into a sink. It is therefore an object of the present invention to provide a double sink cover which quickly facilitates thawing of frozen foods placed thereon.

It is yet another object of the present invention to provide a double sink cover which is capable of thawing frozen foods while simultaneously increasing the counter space available to a user.

It is yet another object of the present invention to provide a double sink cover which has a means for transporting leaking water from a faucet into the sink without allowing the water to contact the cover.

It is yet another object of the present invention to provide a sink cover having a gasket around the periphery thereof to provide a water tight seal. Other objects, features and advantages of the present invention its details of construction and arrangement of parts will be seen from the following description of the preferred embodiment when considered with the attached drawings and the appended claims.

DESCRIPTION OF THE PREFERRED EMBODIMENT

Figure 2:
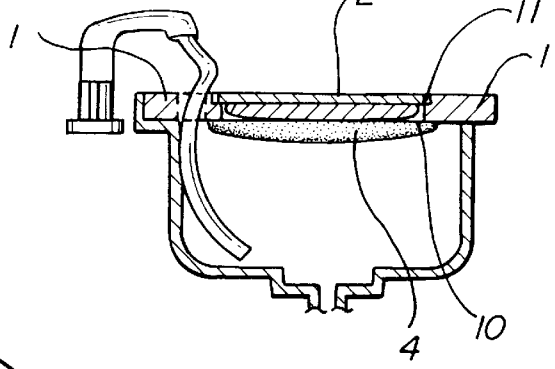
FIG. 2 depicts a side cross sectional view of the inventive device with the gel packs and thawing plates resting within their respective recesses.
Figure 1:
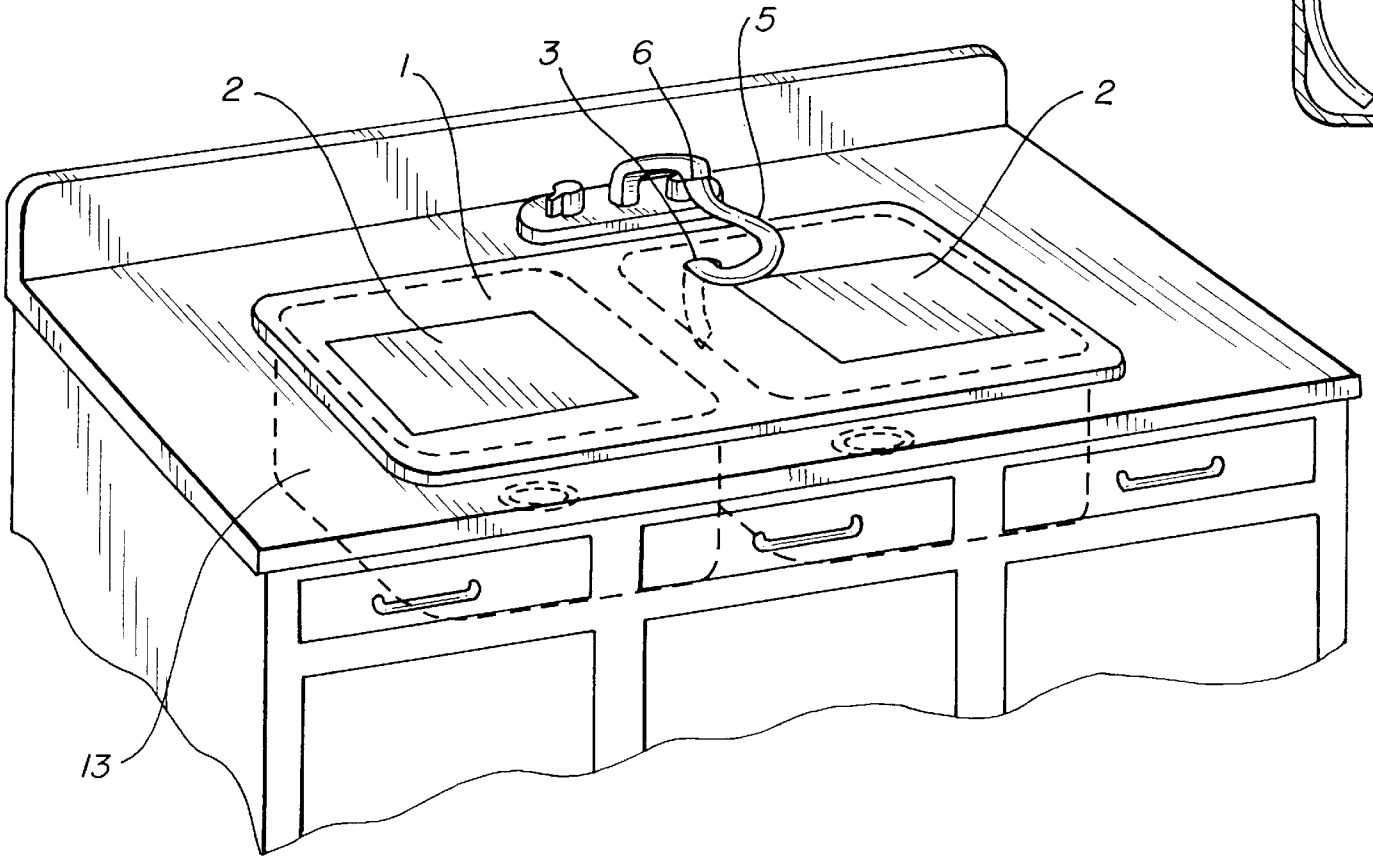
FIG. 1 depicts the inventive device resting flat on a double sink, the two conductive thawing panels as well as a hose connected to a faucet.
Figure 3:
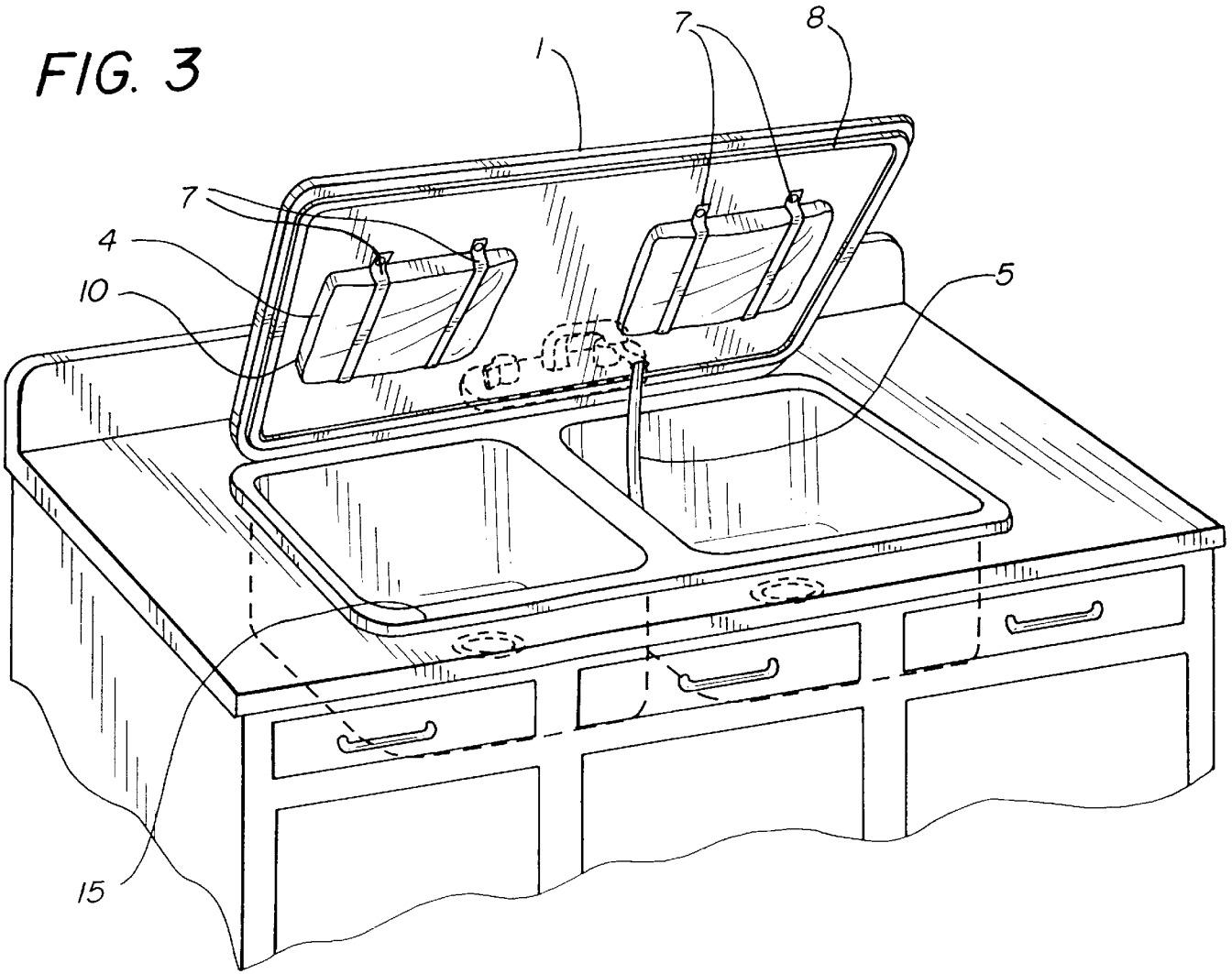
FIG. 3 depicts the bottom surface of the inventive device including the removably attached microwavable gel packs.

Referring now to FIGS. 1 through 2, the present invention comprises substantially planar rectangular cover member 1 having four peripheral edges, rounded corners, a bottom surface and a top surface. The cover member 1 is dimensioned such that its peripheral edges rest on top of the peripheral edges 15 of a standard double sink 13. However, as will be seen by those skilled in the art, the sink cover may be dimensioned to fit any wide variety of sink sizes or shapes.

On the top surface of the cover member 1 are a plurality of recesses each of which receive a substantially square thawing panel 2. In the preferred embodiment, the two recesses 11 are provided with two thawing panels 2 resting therein as depicted in FIG. 1. The thawing panels 2 rest within the recesses 11 such that the top surface of each plate is flush with the top surface of the cover member 1. The thawing plates are constructed from a highly conductive material such as aluminum or steel. Preferably, the conductive thawing plates are powder coated. Powder coating is a process generally known in the prior art in which the metal surface is positively charged. A powder spray gun imparts a negative charge to the microscopic spheres of powder which are then dispersed about the surface of the metal. The metal piece is then oven baked which fuses the microscopic spheres into a smooth homogeneous coating. Pretreating the aluminum in this manner allows the surface of the thawing plates to be easily cleaned.

The cover member 1 also has an aperture 3 therethrough for receiving a hose 5 which may be removably attached to a kitchen faucet 6 so that dripping water may drain through the cover member 1 and into the sink 13. On the bottom surface of the cover member 1 are a plurality of straps 7 for securing a plurality of microwavable gel packs 4. However, any other similar attachment means may be used to attach the gel packs 4 to the bottom surface of the cover member 1. The gel packs 4 are received within recesses 10 on the bottom surface of the cover member. The gel packs preferably contact and are directly underneath the thawing panels 2 so that heat may be transferred more efficiently from the gel pack 4 to the top surface of the thawing panels. On the bottom surface adjacent the peripheral edges of the cover member 1 is a gasket 8 made from foam rubber or other suitable material which provides a water tight seal when the cover is placed on top of a sink's peripheral edges 15. The gasket 8 is spaced at predetermined distance from the edges of the cover member to create a gap whereby the gasket rests tightly against the sink 13 walls. The portion of the bottom surface of the cover member 1 between the gasket 8 and the edges rests on top a sink's peripheral edges 15. Attaching the gasket in this manner provides a water tight seal.

To use the device as described above, the cover member 1 is simply placed across a double kitchen sink 13. Preferably, the hose 5 is connected to the faucet 6 and threaded through the aperture 3 on through the cover member 1. Should the user decide to thaw food thereon, the microwavable gel packs 4 may be removed and heated inside a microwave for a predetermined duration. The heated gel packs 4 are then attached to the bottom surface of the cover member 1 allowing food to be thawed on the thawing panels. As will be readily apparent to those skilled in the art, the above described device may be manufactured using various materials and the shape and size of the various components may be varied to suit a particular application. Preferably the cover member is constructed with plywood having a laminated Formica surface. However, many other materials will suffice. It is understood that although there has been shown and described the preferred embodiment of the described invention that modifications may be made to the invention which do not exceed the scope of the appended claims. Accordingly the scope of my invention is to be limited only by the following claims:

We claim:

1. A double sink cover comprising:

a planar, substantially rectangular cover member, having a top surface, a bottom surface and four peripheral edges, dimensioned so that its peripheral edges fit onto the peripheral edges of a kitchen sink for selectively covering the sink;

a plurality of recesses on the top and bottom surfaces of said cover member;

a plurality of thawing plates received with said recesses on the top surface of said cover member;

a plurality of microwavable gel packs received within the recesses on the bottom surface of said cover member and engaging said thawing panels.

2. A sink cover according to claim 1 wherein said cover member further comprises an aperture.

3. A sink cover according to claim 2 further comprising a hose removably attachable to a faucet typically found adjacent the kitchen sink and extending through said aperture whereby water leaking from said faucet will drip directly into the sink and will bypass said cover member.

4. A sink cover according to claim 1 further comprising a strip of foam rubber material disposed about the periphery of the cover member on its bottom surface at a predetermined distance from its peripheral edges.

5. A sink cover according to claim 1 wherein said thawing plates are powder coated.

6. A sink cover according to claim 1 further comprises means for securing said gel packs within said recesses.

* * * * *